United States Patent [19]

Edwards

[11] 3,955,813

[45] May 11, 1976

[54] COPY SHEET PEELER BAR HAVING FLUID JET ASSIST

[75] Inventor: Earl G. Edwards, Boulder, Colo.

[73] Assignee: International Business Machines Corporation, Armonk, N.Y.

[22] Filed: Feb. 7, 1975

[21] Appl. No.: 548,136

[52] U.S. Cl. ..... 271/174; 118/60; 118/245; 271/DIG. 2; 271/195

[51] Int. Cl.[2] ..... B65H 29/56

[58] Field of Search ..... 271/174, 80, DIG. 2, 271/195; 355/3 R, 3 FU; 118/60, 245; 432/60; 34/120

[56] References Cited

UNITED STATES PATENTS

| | | | |
|---|---|---|---|
| 3,318,212 | 5/1967 | Rubin | 355/3 R |
| 3,506,259 | 4/1970 | Caldwell et al. | 271/174 |
| 3,572,692 | 3/1971 | Bishop | 271/195 |
| 3,704,881 | 12/1972 | Suda | 271/174 |
| 3,811,821 | 5/1974 | Ariyama et al. | 432/60 X |

*Primary Examiner*—Evon C. Blunk
*Assistant Examiner*—Bruce H. Stoner, Jr.
*Attorney, Agent, or Firm*—Francis A. Sirr

[57] ABSTRACT

A xerographic copying apparatus having a hot roll fuser and a peeler bar which includes a fluid jet to assist in stripping the toned copy sheet from the hot roll. The peeler bar and jet geometry cooperate with the fusing nip to create aerodynamic forces which tend to peel the sheet's leading edge from the hot roll. This force producing means includes an air jet. The air jet produces pressure differentials to initially pick and guide the sheet's leading edge from the hot roll. The combination of these pressure differentials and the peeler bar's guide surface, positioned to one side of the sheet's path downstream of the hot roll, provides an unconfined and sole support guidance means for the sheet as it leaves the hot roll.

5 Claims, 8 Drawing Figures

COPY SHEET PEELER BAR HAVING FLUID JET ASSIST

BACKGROUND AND SUMMARY OF THE INVENTION

The present invention relates to the field of electrophotography and particularly to the process step of enhancing the removal of a thin foil, such as a sheet of copy paper, from the surface of a cooperating roll or drum. More specifically, the present invention relates to the xerographic process step of fusing toner to support material by a contact fuser, for example, a hot roll fuser, and to a means of enhancing the removal of the leading edge of a copy sheet as this leading edge emerges from the fusing nip formed by a hot roll and a backup roll.

In the xerographic process a toned visual image is transferred to a copy medium, for example a sheet of copy paper, at a transfer station. The toner is usually a pigmented thermoplastic resin. The individual toner particles are formulated such that they will soften under heat. When soft, they firmly stick to the surface of the copy paper. In order to use the toned copy paper it is necessary to heat the toner to a relatively high temperature, usually in excess of 200° F. One method of so heating the toner is by a contact fuser. One such fuser operates to pass the toned copy sheet through a fusing nip formed by a heated driven fuser roll and a backup roll. This step of contact fusing usually produces a tendency for the toned side of the copy paper to adhere to the surface of the hot roll when contaminants are present on the hot roll. If the sheet of copy paper should adhere to the hot roll, a paper jam or roll-wrap occurs. It is conventional to employ a hot roll having a low energy surface material which enhances release of the copy paper, and in addition, an applicator may be used to apply a release agent to the surface of the hot roll.

The present invention improves the releasing ability of such a hot roll by the use of a tapered guide surface located closely adjacent the hot roll surface a short distance downstream from the fusing nip. The guide surface geometry operates in conjunction with a blowing air jet to create aerodynamic forces which operate to lift the sheet's leading edge from the surface of the hot roll, and to thereafter guide this edge into the nip formed by a drive roll couple located further downstream.

The foregoing and other features and advantages of the invention will be apparent from the following more particular description of preferred embodiments of the invention, as illustrated in the accompanying drawing.

DESCRIPTION OF THE PREFERRED EMBODIMENTS

Figure 1:
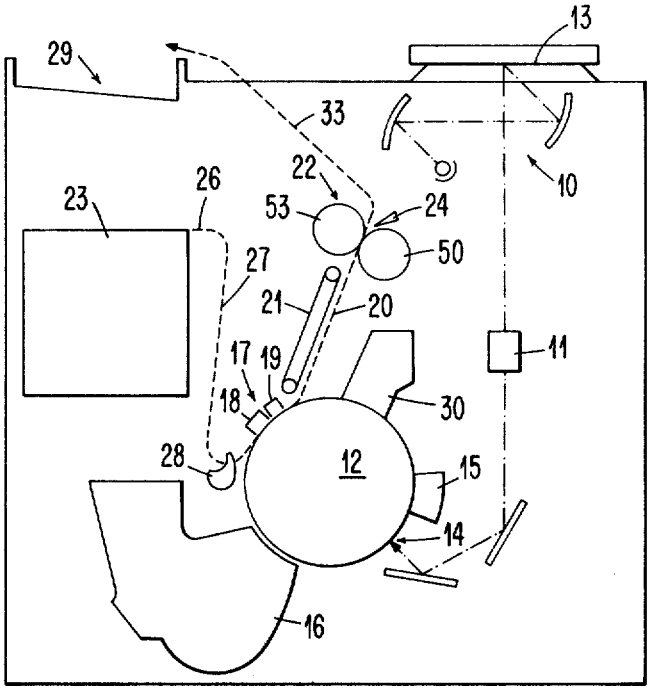
FIG. 1 is a schematic view of a xerographic copying apparatus incorporating the present invention.

FIG. 1 is a schematic view of a xerographic copying apparatus incorporating the present invention. In this device a scanning mirror system 10 and a moving lens 11 move in synchronism with the rotation of photoconductor drum 12 to place a latent image of an original document 13 onto the drum's surface. As is well known, prior to imaging at 14 the drum is charged by corona 15. After imaging, the drum's latent image is developed by magnetic brush developer 16. Thereafter the drum's toned visible image is transferred to a sheet of copy paper at transfer station 17 by operation of transfer corona 18. Sheet detach means 19 operates to cause the now toned sheet to leave the surface of the drum and to follow sheet path 20, adjacent vacuum conveyor 21 on its way to hot roll fuser assembly 22. After fusing, the finished copy sheet follows sheet path 33 and is deposited in tray 29. After transfer, the drum is cleaned as it passes cleaning station 30.

The apparatus of FIG. 1 includes a copy sheet supply bin 23. This supply bin includes a bidirectionally movable elevator which supports the bottom sheet of the stack. While this structure is well known to those of skill in the art, an exemplary structure is described in the IBM TECHNICAL DISCLOSURE BULLETIN of August 1974, at pages 670 and 671. The bin is operable to feed the top sheet of the stack to sheet discharge path 26. This sheet then travels down sheet path 27 to be momentarily stopped at gate 28. When the leading edge of the drum's toned image arrives at the vicinity of the gate, the gate is opened to allow the sheet to progress into transfer station 17 in exact registry with the drum's image. An exemplary means of picking the top sheet from the bin is described in the IBM TECHNICAL DISCLOSURE BULLETIN of February 1974, at pages 2966 and 2967.

The present invention provides an improved peeler bar means 24 as a portion of hot roll fuser 22 to assist in stripping the toned copy sheet from hot roll 50 and to prevent adhesion of the released sheet's leading edge to backup roll 53. Generically, the present invention finds utility in assisting in the removal of flexible foil material from a processing roll and its description in the environment of a hot roll fuser is not to be taken as a limitation on its broader generic utility.

The construction of the hot roll fuser will not be described in detail since this construction is well known in the art. Generally, hot roll 50 is heated to an accurately controlled temperature by an internal heater and associated temperature control system, not shown. The hot roll preferably includes a deformable external surface formed as a thin elastomeric surface. This surface is designed to engage the toned side of the copy sheet, fuse the toner thereon, and readily release the sheet with a minimum adherance of residual toner to the hot roll. Such a hot roll is described, for example, in the IBM TECHNICAL DISCLOSURE BULLETIN of August 1973, at page 896.

The nip formed by rolls 50 and 53 is preferably opened and closed in synchronism with the arrival and departure of the leading and trailing edges, respectively, of a copy sheet. This synchronism is achieved by a drum position sensing means, not shown, which responds to the position of drum 12 and effects opening and closing of the nip by means of a control system, not shown. An exemplary mechanism for effecting the opening and closing of this nip is shown in the IBM TECHNICAL DISCLOSURE BULLETIN of May 1973, at page 3644.

Figure 2:
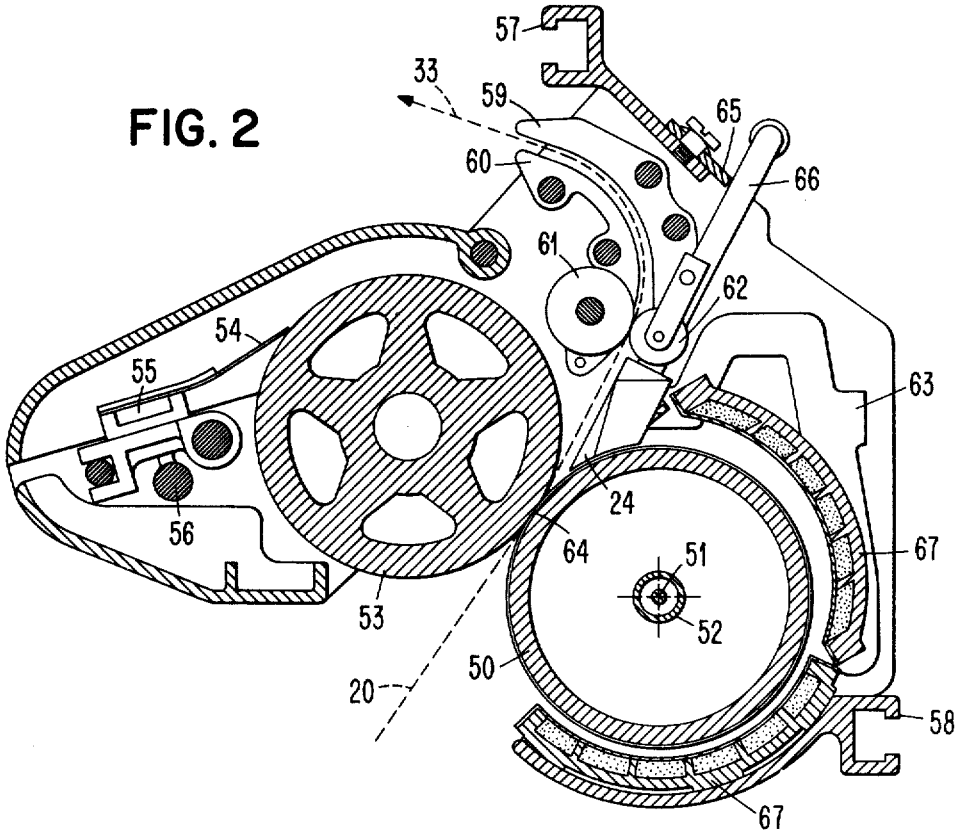
FIG. 2 is a side view of FIG. 1's hot roll fuser, showing the detailed construction thereof.

FIG. 2 discloses FIG. 1's hot roll fuser 22 in detail. Hot roll 50 is an aluminum cylinder having a thin silicone elastomer outer layer. A pair of insulating end walls are fitted into cylinder 50 at each end and support bearings which, in turn, support the cylinder for rotation about axis 51. A conventional Tungsten filament infrared heating lamp 52 is located along this axis. A reflective end plate may be carried within the cylinder at each end to improve the axial uniformity of heat reception by the cylinder from lamp 52. The inner surface of cylinder 50 is colored black to improve its radiant energy absorption characteristic.

Backup roll 53 is made of a tubular aluminum extrusion having a relatively heavy cylindrical wall section and, for example, an outer surface of aluminum oxide. This outer surface is honed and lapped for smoothness. Other outer surfaces which may be used for backup roll 53 include polytetrafluoroethelene, chromium oxide or aluminum oxide embedded with polytetrafluoroethelene particles. The outer surface of the backup roll provides a hard, thin insulating surface that is not marred by cleaning blade 54. The insulating character of the coating layer minimizes the reception of heat by the backup roll from the heated roll during contact therewith. The thinness of the outer surface of the backup roll enables such heat as is received to be rapidly spread throughout its heavy cylindrical wall section thereby providing a backup roll surface having no large thermal gradients along its axis.

A relatively narrow cleaning blade 54 is supported on carriage 55. This carriage axially traverses the backup roll by means of a compound fish-reel type double helix lead screw 56 and operates to scrape any toner that may be received by the backup roll surface during use. Blade 54 traverses backup roll 53 continually as long as the backup roll is rotated. Blade 54 goes beyond the operative surface of backup roll 53, to a position where it overlaps the roll's edge surface. At this location, there appears to be a tendency for the backup roll to clean toner accumulated on the underside of the cleaning blade. Droppings from the cleaning blade are accumulated in a trough carried by the fuser assembly frame.

The entire fuser unit of FIG. 2 is supported from the copy machine frame by a pair of extruded rail portions 57 and 58. Exit guide ways 59 and 60 and exit roll couple 61, 62 are movably mounted to enable movement to an open position for removal of a copy sheet in the case of a jam. A pair of side frames 63 movably support peeler bar means 24 adjacent the hot roll 50 just downstream of fusing nip 64. A camming handle 65 can be manually pivoted by the operator to wedge against rigid tube 66 and move the peeler bar means 24 a small distance to free a copy sheet that may have become jammed between the hot roll surface and the peeler bar means.

An insulated shield 67 surrounds a substantial portion of heated roll 50 and includes a reflective inner surface to minimize heat loss by radiation to surrounding structure. Insulating foam material on the shield's outer surface prevents an operator from being injured while handling the shield. Exit way plates 59 and 60, defining the fuser exit paper path, provide a rigid structure having a good capability for heat dissipation, and provide minimum contact surface to freshly fixed copy sheets.

Figure 3:
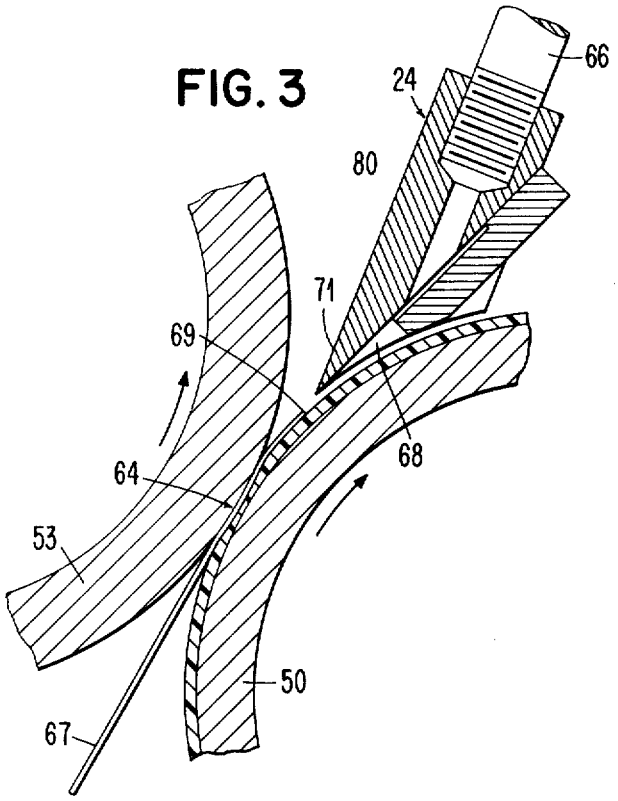
FIG. 3 is a side view of the fusing nip and the cooperating peeler bar means shown in FIG. 2.
Figure 8:
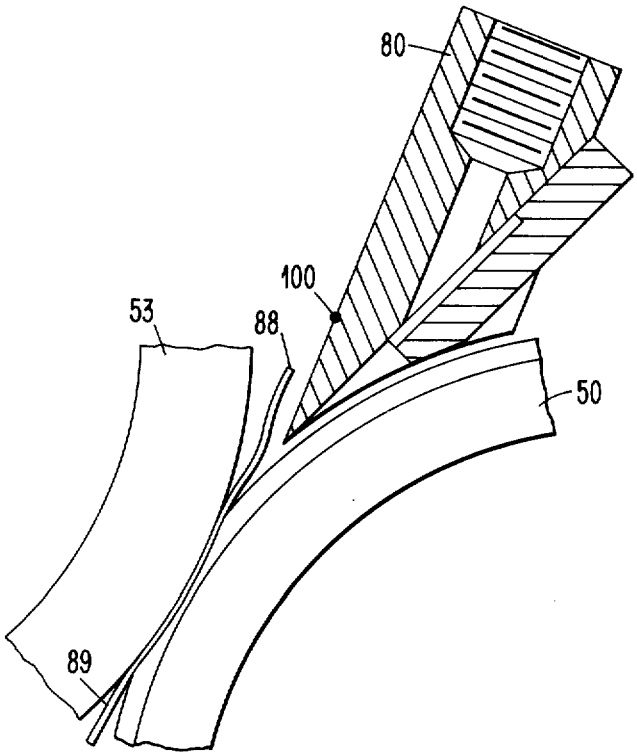
FIG. 8 is a view similar to FIG. 7 with the leading edge of the copy sheet detached from the hot roll and moving on its way to the downstream exit roll couple shown in FIG. 2.

As shown in FIG. 3, the deformable outer surface layer of heated roll 50 is indented by backup roll 53 to produce at the exit of nip 64 a curvature tending to separate paper copy sheet 67 from the surface of heated roll 50. Under some conditions, the leading edge may not release properly. Peeler bar means 24 includes a nozzle 68 in a location that is centered on the leading edge of the copy sheet. The nozzle projects a jet of air tangentially along the heated roll surface, prior to the arrival of the sheet's leading edge 69. While the dynamic effect of this air jet is not completely understood, it is believed that the jet attaches to the fuser roll surface, by boundary layer Coanda effects, and then stagnates in the wedge formed by the mating rolls. This stagnation causes an increase in pressure which can cause the flow to separate from the roll surface. Under these conditions, pressure differences exist which can provide initial lifting of the still-attached leading edge as the sheet exists fuser nip 64. Airflow to nozzle 68 is controlled by a solenoid valve, not shown. This valve is opened just prior to the arrival of the sheet's leading edge into fuser nip 64, and is maintained open until the sheet's leading edge has been received by the exit roll couple 61, 62, FIG. 2. With the lifting of the leading edge from the fuser roll accomplished, a new wedge is formed, consisting of the sheet and fuser roll 50, into which the flow stagnates, further enhancing release of the sheet. As the region of separation spreads laterally across the leading edge, the separated leading edge deflects outwardly away from the hot roll surface. This action continues until the leading edge is forced back adjacent guide surface 71 of the peeler bar means. In this condition, the released portion of the sheet experiences a pressure differential, with the lower pressure region being below, i.e. to the right of the sheet as shown in FIG. 8. The sheet's leading edge is thus forced against guide surface 71 and is maintained within a relatively precise guide path where it can be inserted into the nip of exit roll couple 61, 62. The jet is maintained operable until the sheet's leading edge 69 is received by the exit roll couple. Sheet separation thereafter is enhanced by tension applied due to the fact that exit roll couple 61, 62 drives the sheet faster than does fuser roll 50.

The above-described operation whereby the released sheet's leading edge is forced against guide surface 71 is particularly advantageous in a situation where there is no tendency of the copy sheet to adhere to the hot roll. In this situation, the sheet's leading edge is forced toward guide surface 71, insuring that it does not follow the contour of the backup roll.

By way of example, the jet may be operated for the first two inches of the copy paper, with roll couple 61, 62 thereafter being operable to cause the copy paper to release from the hot roll.

The peeler bar means 24 of the present invention effects release of the copy sheet from the fuser's hot roll by two primary effects. The air jet provides an initial lifting force by means of pressure differences exerted on the sheet. After lift has initially been accomplished, the peeler bar maintains this lift by projecting a portion of its leading edge into the lift zone. Thereafter, the release of the remaining leading edge of the copy sheet is accomplished by a combination of the jet's action and the peeler bar geometry.

The air jet may operate to enhance release of the toned copy sheet by cooling the molten toner. This cooling could aid in release from the hot roll by reducing the toner's surface free energy, i.e. reducing adhesive forces between toner and the hot roll.

Figure 5:
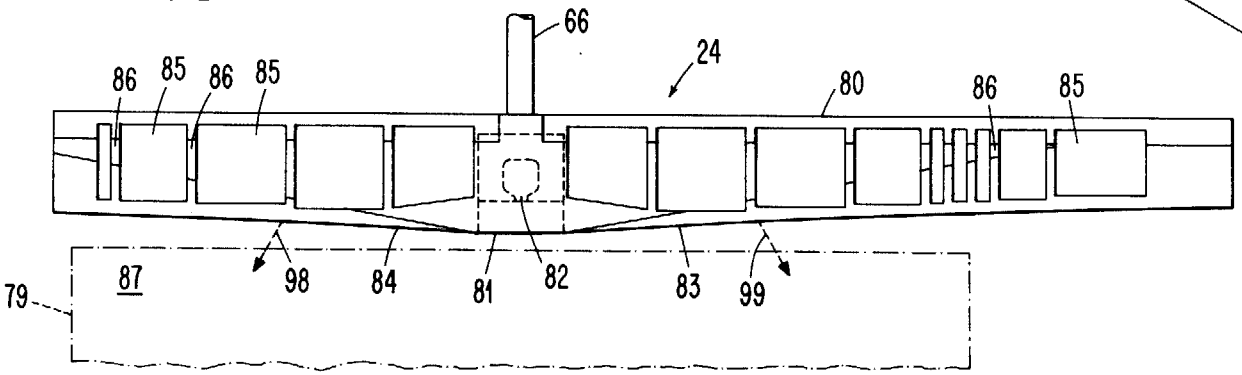
FIG. 5 is a view of the peeler bar means as seen from the side thereof which cooperates with the sheet of copy paper released from the hot roll.

FIG. 5 is a view of this peeler bar means, as seen from the side thereof which cooperates with the sheet of copy paper. As can be seen, bar 80 defines a paper guide surface having an upstream edge 81 positioned downstream of the fusing nip 64 (shown in FIG. 2). Nozzle 82 lies on the underside of bar 80, i.e. the side of the bar facing hot roll 50. This nozzle directs an air jet through the space between edge 81 and fusing nip 64. The receding edges 83 and 84 of bar 80 are spaced from hot roll 50 by a distance equal to the spacing of edge 81 from this surface. Thus edges 83 and 84 define a helix such that all points on the composite edge 84, 81, 83 are at a constant distance from the hot roll, for example 0.010 inch. This helix profile progressively exposes a greater portion of the sheet's leading edge to stripping action. The surface of bar 80 includes a plurality of recessed portions 85 which define upstanding ribs 86 therebetween. The function of these ribs is to provide minimum contact area with the released leading edge of the copy sheet. Air under pressure is supplied to nozzle 81 from conduit 66. By way of example, nozzle 82 may be formed by a rectangular opening 0.15 inch wide (measured in a direction parallel to the hot roll) and 0.02 inch in height. The pressurized air may be nine pounds per square inch, with a flow rate of 1 cubic foot per minute and with a jet pulse duration of 230 milliseconds.

Dotted outline 87, in FIG. 5, depicts a sheet advancing toward bar 80, and shows that edge 81 is centered on this sheet. If sheets of varying widths are to be occasionally fused, bar 80 would be extended. If these variable width sheets have a common edge, such as edge 79, then the right-hand surface 83 of bar 80 could be extended as shown in FIG. 5.

Figure 6:
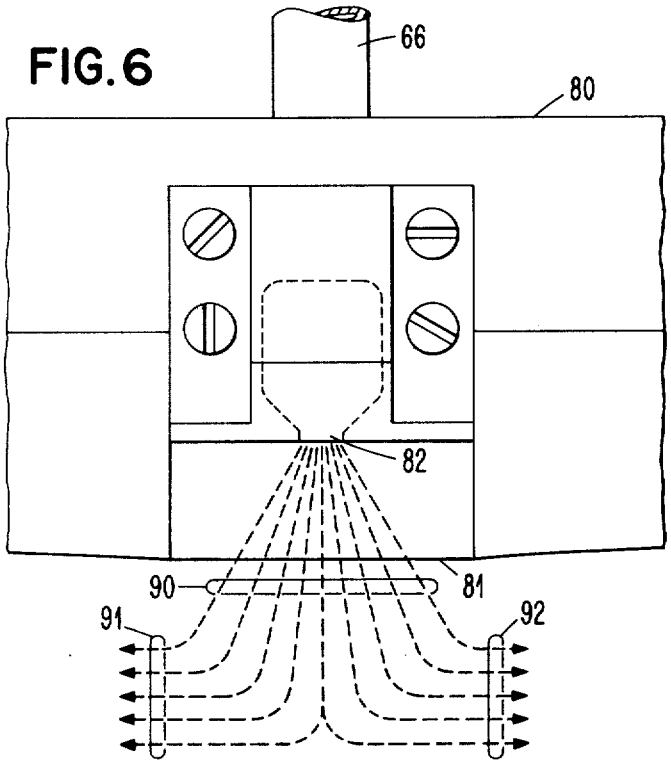
FIG. 6 is a view of the peeler bar means air jet, as seen from the side thereof which cooperates with the hot roll.
Figure 4:
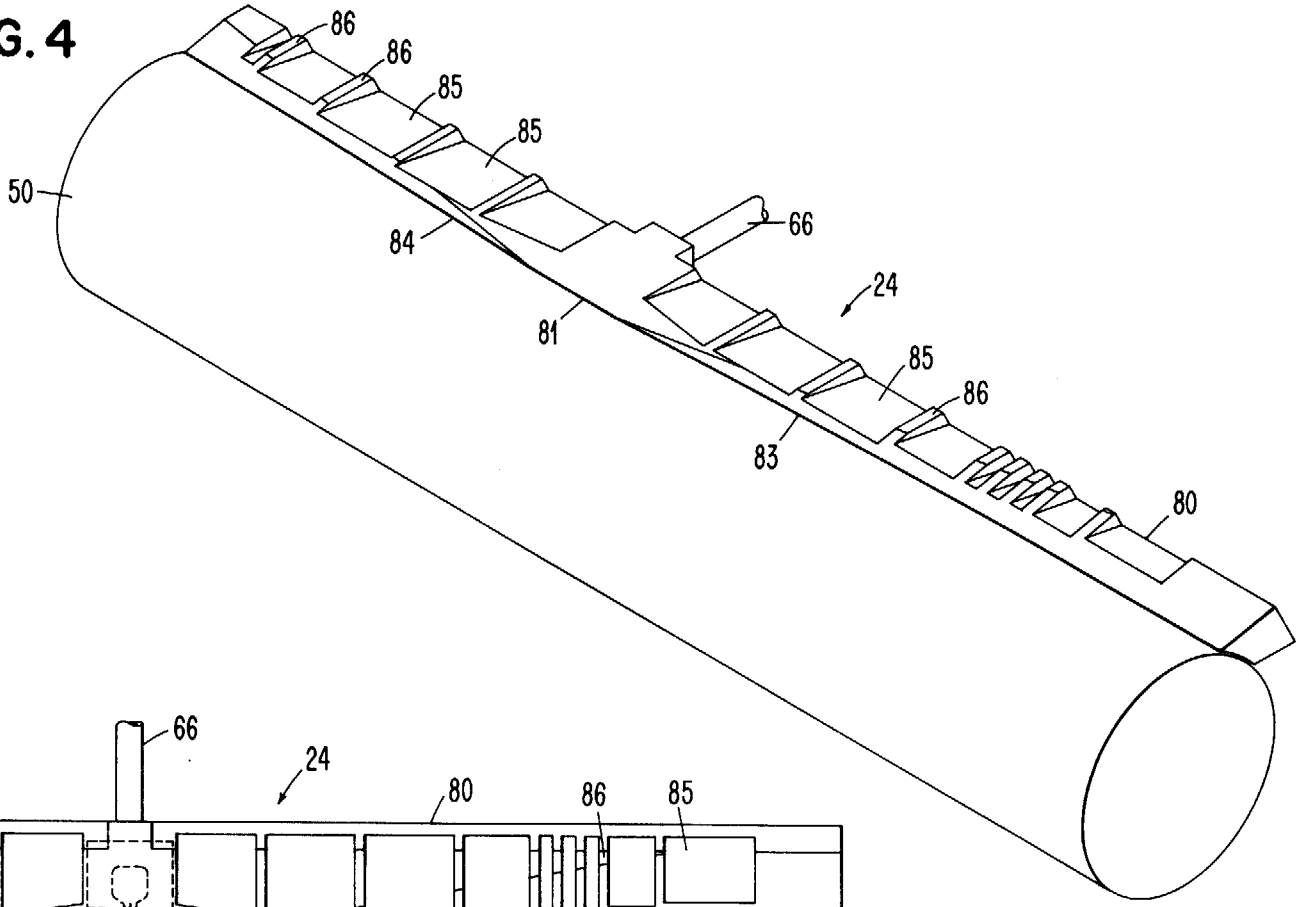
FIG. 4 is a perspective view of the peeler bar means and the cooperating hot roll.
Figure 7:
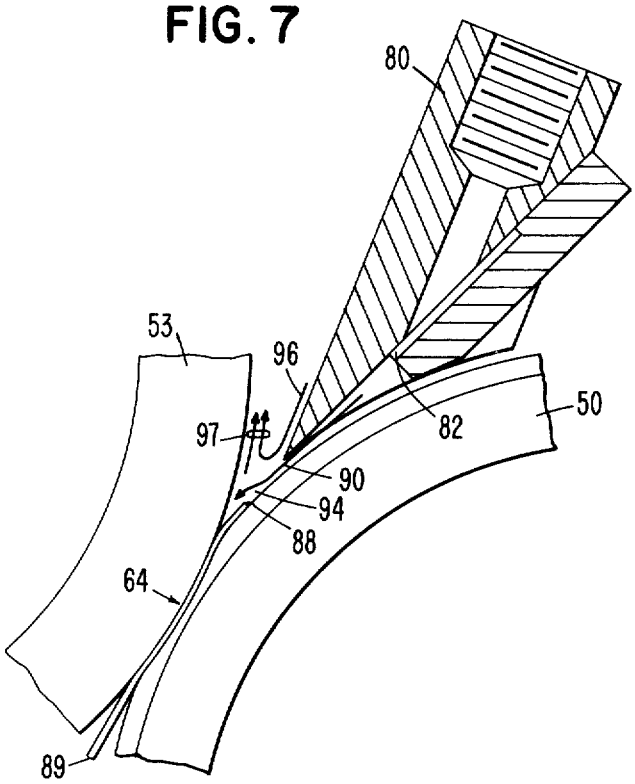
FIG. 7 is a view of the peeler bar means, hot roll and backup roll with the leading edge of a copy sheet emerging from the fusing nip.

FIG. 7 is a view of bar 80 with the leading edge 88 of a copy sheet 89 emerging from fusing nip 64. The flow of air from nozzle 82, into the gap formed by hot roll 50 and backup roll 53, is complex and not completely understood. However, it is believed that air begins to flow tangent to the hot roll, as shown at 90. It then follows the roll's contour, rather than flowing in a straight line, due to the well known Coanda flow effect. This flow pattern continues until the flow reaches the obstruction created by the fusing nip. This obstruction causes stagnation and lateral division of the airflow, as seen at 91 and 92 of FIG. 6. In this stagnation process some of the jet's kinetic energy is converted to an increase in pressure which propogates upstream toward orifice 82 and causes the jet to separate as shown at 94. As a result, pressure differentials are created above the sheet. As the leading edge 88 of the copy sheet enters this flow, it is subjected to a force lifting it off roll 50. In addition, the forward facing step created by the sheet' s leading edge, due to the paper's thickness, aids in separation of the leading edge by presenting another obstacle to jet flow.

The flow dynamics of jet 90 cause secondary air to be entrained into the fusing nip, as indicated at 96. The total air quantity presented to the fusing nip exists therefrom by lateral flow 91 and 92 (FIG. 6) and by flow along backup roll 53, as shown at 97 (FIG. 7).

As a result of these flows, a velocity difference, hence a pressure difference, exists across the leading portion of the sheet. The lower pressure region exists between the sheet and the peeler bar, causing the sheet to be forced against the peeler bar. Thus control, direction wise, is maintained on the sheet's leading edge.

If desired, the portion of bar 80 outboard of edge 81 may include one or more additional air jets, such as 98 and 99 of FIG. 5, which are angled away from edge 81 and assist in both sheet separation and lateral airflow out of the fusing nip.

FIG. 8 discloses the dynamic position of sheet 89 and the manner in which airflow 96 of FIG. 7 and flows 91 and 92 of FIG. 6 creates a low pressure adjacent the surface of bar 80 such that the sheet's leading edge 88 is forced toward the bar, to impact the bar at approximately point 100.

While the invention has been particularly shown and described with reference to preferred embodiments thereof, it will be understood by those skilled in the art that various changes in form and details may be made therein without departing from the spirit and scope of the invention.

What is claimed is:

1. Apparatus for separating a copy sheet from the elongated fusing nip formed by a hot roll and a backup roll, comprising:

a peeler bar positioned adjacent said hot roll including a contoured edge spaced from said fusing nip, said edge comprising a central portion which is the closest to said nip, and two outboard edges which define a helix about said hot roll as they recede from said fusing nip; and at least one fluid jet formed on the side of said peeler bar which faces said hot roll, said jet being located in the proximity of said central portion, said jet being oriented to direct fluid flow against the surface of said hot roll and substantially normal to said fusing nip.

2. The fuser assembly defined in claim 1 wherein each of said outboard edges includes surface ribs on the side thereof opposite said hot roll.

3. The apparatus defined in claim 1 including a drive roll couple located downstream of said fusing nip from said peeler bar.

4. The fuser assembly defined in claim 3 including means mounting said hot roll and said backup roll such that said sheet's leading edge exists said fusing nip while traveling substantially vertically upward.

5. The apparatus defined in claim 1 wherein said two outboard edges include at least one fluid jet formed on the side of said peeler bar which faces said hot roll, said jet being oriented to direct fluid flow at an angle to said fusing nip and away from said central portion.

* * * * *